US006962136B2

(12) United States Patent
Hayman

(10) Patent No.: US 6,962,136 B2
(45) Date of Patent: Nov. 8, 2005

(54) METHODS FOR STARTING A MULTI-CYLINDER INTERNAL COMBUSTION ENGINE

(75) Inventor: Alan W. Hayman, Romeo, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/624,172

(22) Filed: Jul. 22, 2003

(65) Prior Publication Data

US 2005/0016486 A1 Jan. 27, 2005

(51) Int. Cl.[7] ..... F02D 43/00
(52) U.S. Cl. ..... 123/179.5; 123/182.1
(58) Field of Search ..... 123/179.16, 179.17, 123/179.18, 182.1, 179.5

(56) References Cited

U.S. PATENT DOCUMENTS 5,101,780 A * 4/1992 Jones ..... 123/182.1
6,637,394 B2 * 10/2003 Marshall et al. ..... 123/179.16

* cited by examiner

*Primary Examiner*—Andrew M. Dolinar
(74) *Attorney, Agent, or Firm*—Christopher DeVries

(57) ABSTRACT

A method is provided for starting an internal combustion engine having a plurality of cylinders, each cylinder having at least one inlet valve and one exhaust valve. In accordance with one embodiment the method includes the steps of opening an inlet valve of any cylinder that would otherwise undergo a wasted power stroke and opening an exhaust valve of any cylinder that would otherwise undergo a wasted compression stroke.

16 Claims, 4 Drawing Sheets

| | INLET VALVE 58 | EXHAUST VALVE 60 (76) | STROKE | INLET VALVE 62 | EXHAUST VALVE 64 (78) | STROKE | INLET VALVE 66 | EXHAUST VALVE 68 (80) | STROKE | INLET VALVE 70 | EXHAUST VALVE 72 (82) | STROKE |
|---|---|---|---|---|---|---|---|---|---|---|---|---|
| 84 FIRST CYCLE | O | X | P | X | O | E | X | O | C | O | X | I |
| 86 SECOND CYCLE | X | O | E | O | X | I | O | X | P | X | X | C |
| 88 THIRD CYCLE | O | X | I | X | X | C | X | O | E | X | X | P |

| | INLET VALVE 34 | EXHAUST VALVE 36 (18) | STROKE | INLET VALVE 38 | EXHAUST VALVE 40 (20) | STROKE | INLET VALVE 42 | EXHAUST VALVE 44 (22) | STROKE | INLET VALVE 46 | EXHAUST VALVE 48 (24) | STROKE |
|---|---|---|---|---|---|---|---|---|---|---|---|---|
| 26 FIRST CYCLE | X | X | P | X | O | E | X | X | C | O | X | I |
| 28 SECOND CYCLE | X | O | E | O | X | I | X | X | P | X | X | C |
| 30 THIRD CYCLE | O | X | I | X | X | C | X | O | E | X | X | P |
| 32 FOURTH CYCLE | X | X | C | X | X | P | O | X | I | X | O | E |

PRIOR ART

*FIG. 2*

| | INLET VALVE 58 | EXHAUST VALVE 60 (76) | STROKE | INLET VALVE 62 | EXHAUST VALVE 64 (78) | STROKE | INLET VALVE 66 | EXHAUST VALVE 68 (80) | STROKE | INLET VALVE 70 | EXHAUST VALVE 72 (82) | STROKE |
|---|---|---|---|---|---|---|---|---|---|---|---|---|
| FIRST CYCLE (84) | O | X | P | X | O | E | X | O | C | O | X | I |
| SECOND CYCLE (86) | X | O | E | O | X | I | O | X | P | X | X | C |
| THIRD CYCLE (88) | O | X | I | X | X | C | X | O | E | X | X | P |

*FIG. 4*

METHODS FOR STARTING A MULTI-CYLINDER INTERNAL COMBUSTION ENGINE

TECHNICAL FIELD

This invention relates generally to a method for starting a multi-cylinder internal combustion engine, and more specifically to a method for reducing the work performed by a starter when starting a multi-cylinder internal combustion engine having intake and exhaust valves that are able to operate and actuate independently of engine timing.

BACKGROUND

In the normal operation of a four-stroke cycle multi-cylinder internal combustion engine (ICE) each cylinder sequentially goes through the four strokes of intake (or induction), compression, power, and exhaust. A crankshaft is driven by pistons moving in the cylinders. A camshaft, turning in concert with the crankshaft, controls the intake and exhaust valves for each cylinder. At start up of the ICE an ignition key is turned in the ignition switch of the engine causing a starter motor to begin turning the crankshaft of the engine. The starter motor continues to turn the crankshaft until the engine reaches a minimum engine rotation measured in revolutions per minute (rpm) and until at least one cylinder has gone through the inlet, compression, power, and exhaust strokes and the ICE can power itself and maintain the minimum rpm. To understand what occurs at start up, it is necessary to consider what happened when the engine was last shut off. At shut off, the engine often turns through a few revolutions without fuel being delivered to the cylinders before the engine completely stops. When the engine does stop rotating, the cylinders may be in or partially through any one of the four strokes. Because fueling was terminated before engine rotation stopped, it is unlikely that any of the cylinders, even the cylinders that have just completed the compression stroke, will be sufficiently fueled to provide power during the first revolution(s) of the crankshaft when the engine is restarted.

The starter motor must turn the crankshaft which, in turn, causes the pistons to move up and down in the cylinders. The non-firing cylinders, those that were insufficiently fueled, cause an additional load on the starter motor. The starter motor must work against the pumping and compressing that occurs in the non-firing cylinders. This pumping and compressing, which is unavoidable in current four-stroke cycle multi-cylinder ICEs in which valve timing is controlled by the camshaft, occurs in cylinders that are left in the compression or power stroke cycles when the engine last stopped turning. Because the non-firing cylinders have insufficient fuel to combust when the engine is started again, these cylinders cannot provide power during the initial cycles, and the starter device must therefore perform extra work to crank these cylinders through wasted power and compression strokes.

Accordingly, it is desirable to have an improved method for starting a multi-cylinder internal combustion engine, and especially an improved method for starting an internal combustion engine that reduces the work that must be performed by the starter motor. Furthermore, other desirable features and characteristics of the present invention will become apparent from the subsequent detailed description of the invention and the appended claims, taken in conjunction with the accompanying drawings and this background of the invention.

BRIEF SUMMARY

A method is provided for starting a multi-cylinder internal combustion engine. The multi-cylinder engine has a plurality of cylinders, each having at least one inlet valve and one exhaust valve. In accordance with one embodiment of the invention, an inlet valve is opened in any cylinder during what would otherwise be a wasted power stroke and an exhaust valve is opened in any cylinder during what would otherwise be a wasted compression stroke.

BRIEF DESCRIPTION OF THE DRAWINGS

The present invention will hereinafter be described in conjunction with the following drawing figures, wherein like numerals denote like elements, and:

FIG. 2 illustrates in chart form the strokes performed and the position of the inlet and exhaust valves in each cylinder in a conventional four cylinder engine at start up;

FIG. 4 illustrates in chart form the strokes performed and the position of the inlet and exhaust valves in each cylinder in a four cylinder engine at start up in accordance with an embodiment of the invention.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Without loss of generality and without limitation, but for ease of description, the discussion herein will focus on a four-stroke cycle, four cylinder internal combustion engine which will hereafter be referred to simply as an "engine." Any discussion herein is equally applicable to internal combustion engines having more or fewer cylinders.

Figure 1:
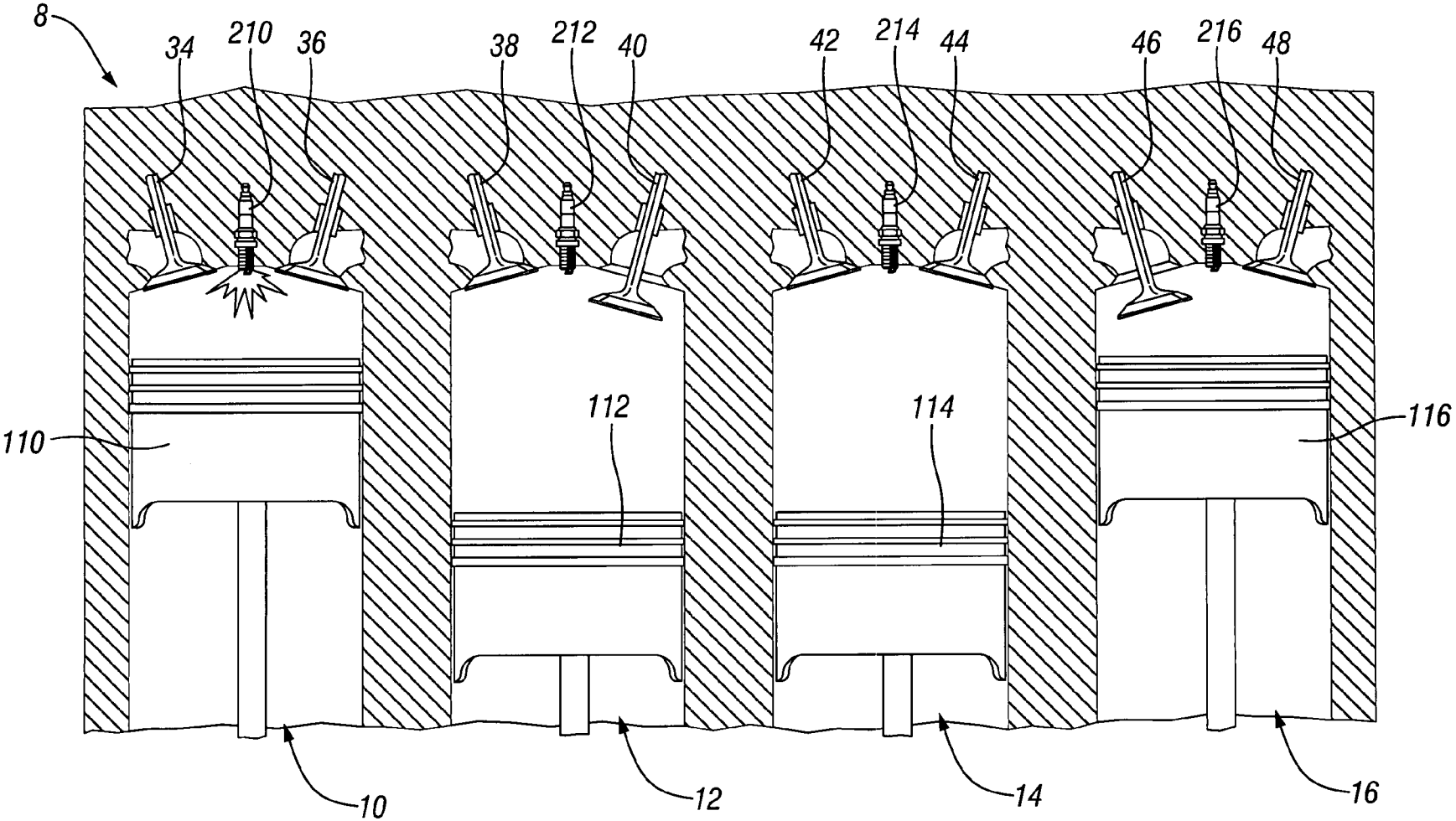
PRIOR ART FIG. 1
FIG. 1 schematically illustrates a conventional two-valve per cylinder, four stroke, four cylinder internal combustion engine.

FIG. 1 schematically illustrates in cross section a conventional four cylinder engine 8 having cylinders 10, 12, 14, and 16 with corresponding pistons 110, 112, 114, and 116, respectively. The typical firing order of the four cylinders of such an engine is 1-3-4-2 (using conventional engine terminology) or, using the figure numerals, 10-14-16-12. For ease of illustration and discussion, cylinders 10 and 16 are illustrated with their respective pistons 110 and 116 initially at top dead center (TDC) and cylinders 12 and 14 are illustrated with their respective pistons 112 and 114 initially at bottom dead center (BDC), and it is assumed that the engine last stopped with the pistons in these positions.

FIG. 2 illustrates in chart form the different strokes each cylinder of engine 8 is prepared to perform once the engine is started, including the position of the inlet and exhaust valves for each cylinder. Columns 18, 20, 22, and 24 correspond to cylinders 10, 12, 14, and 16 respectively, and rows 26, 28, 30, and 32 correspond to the first four cycles of the engine, respectively. In all of this discussion the term "cycle" will refer to the normal four strokes of a four-stroke cycle internal combustion engine, namely intake, compression, power, and exhaust. In FIG. 2, the letters "I," "C," "P," and "E" refer to those four strokes. An "x" indicates a valve is closed, and an "o" indicates a valve is open.

Although cylinder 10 was chosen for purposes of illustration as the cylinder about to perform the power stroke, the process would be the same, although the cylinder numbering would be different, if the four cylinder engine had previously been stopped with a different cylinder about to perform the power stroke. As used herein, the terms "upward" and "downward" refer to direction of piston travel within the cylinder; "upward" means the piston is traveling from BDC to TDC, and "downward" means the piston is traveling from TDC to BDC.

Referring again to FIGS. 1 and 2, when the four cylinder engine is started, the starter motor (not illustrated) is coupled to and begins to turn the crankshaft (not illustrated) which, in turn, is coupled to and causes the pistons to move in their respective cylinders. As illustrated, cylinder 10 is about to perform a power stroke. Both inlet valve 34 and exhaust valve 36 are closed in cylinder 10 and piston 110 is at the uppermost position in the cylinder. Upon start up, spark plug 210 will deliver a spark to cylinder 10, but no power is generated because there is no fuel/air mixture in the cylinder to ignite and drive the piston downwards through the power stroke. The power stroke thus is wasted, and instead the starter motor must manually pull the piston downwards. The act of pulling piston 110 downward is difficult because the inlet and exhaust valves are closed and a vacuum or reduced pressure is created in the cylinder above the piston (hereinafter referred to as a "reduced pressure load") as the piston moves downward. The reduced pressure load in cylinder 10 causes the starter motor to perform unnecessary work as the crankshaft is turned through the first cycle. While cylinder 10 is undergoing a power stroke, cylinder 12 is undergoing an exhaust stroke as upward traveling piston 112 pushes air through open exhaust valve 40. At the same time, cylinder 14 is undergoing a compression stroke. Both inlet valve 42 and exhaust valve 44 are closed. The starter motor turns the crankshaft causing piston 114 to move upward, compressing the air in cylinder 14. The compression stroke in cylinder 14 again causes the starter motor do unnecessary work, as there is no fuel in the cylinder, so this compression stroke is wasted. At the same time cylinder 16 is undergoing an intake stroke during which piston 116 travels downward drawing a fuel/air mixture into the cylinder through open inlet valve 46. During this first cycle the starter motor provides the power necessary to turn the crankshaft. Because there is no fuel in either of cylinders 10 or 14, the starter motor performs unnecessary work in moving pistons 110 and 114 in these cylinders because of the reduced pressure load in cylinder 10 and the required compression of (fuel-less) air in cylinder 14.

During the second cycle, as also illustrated in FIG. 2, cylinder 10 undergoes an exhaust stroke. Exhaust valve 36 opens and the upward traveling-piston 110 pushes air out of the cylinder through the exhaust valve. At the same time, cylinder 12 undergoes an intake stroke. Inlet valve 38 opens and piston 112 travels downward. A fuel/air mixture is injected into the cylinder through the open inlet valve. At the same time, piston 114 is in position to perform a power stroke in cylinder 14, but this cycle is ineffective, because there is no fuel in the cylinder to be ignited when a spark is delivered to the cylinder by spark plug 214. The starter motor again must manually pull the piston downwards against a reduced pressure load, requiring the starter to perform extra work. Cylinder 16 undergoes a compression stroke, with piston 116 moving upward to compress the fuel/air mixture that was injected into the cylinder during the previous cycle. For this second cycle, therefore, the starter motor is the only force providing power necessary to turn the crankshaft, but during this cycle the starter motor only has to perform extra, unnecessary pumping work on cylinder 14.

During the third cycle, as illustrated in FIG. 2, inlet valve 34 in cylinder 10 opens and a fuel/air mixture is injected into the cylinder as piston 110 travels downward in an intake stroke. Cylinder 12 performs a compression stroke with both inlet valve 38 and exhaust valve 40 closed and piston 112 moving upward to compress the fuel/air mixture that was injected during the previous cycle. In cylinder 14, exhaust valve 44 opens and upward traveling-piston 114 pushes the air in the cylinder through the exhaust valve. Cylinder 16 performs a power stroke, with the compressed fuel/air mixture being ignited by a spark provided by spark plug 216 and the resulting, rapidly expanding gases pushing piston 116 downward. During this cycle no unnecessary work is performed by the starter motor to counteract pumping or compression drag, because there are no wasted power strokes or compression strokes. Because cylinder 16 has begun to deliver power to turn the crankshaft, less power is required from the starter motor for this cycle. In the fourth and subsequent cycles, as illustrated in FIG. 2, the cylinders begin firing normally and contribute to the powering of the engine. At this time, depending on how readily the engine is firing, the starter motor may stop manually turning the crankshaft, although the starter motor usually remains coupled to the crankshaft until the crankshaft attains a rotational speed of about 60 rpm.

Figure 3:
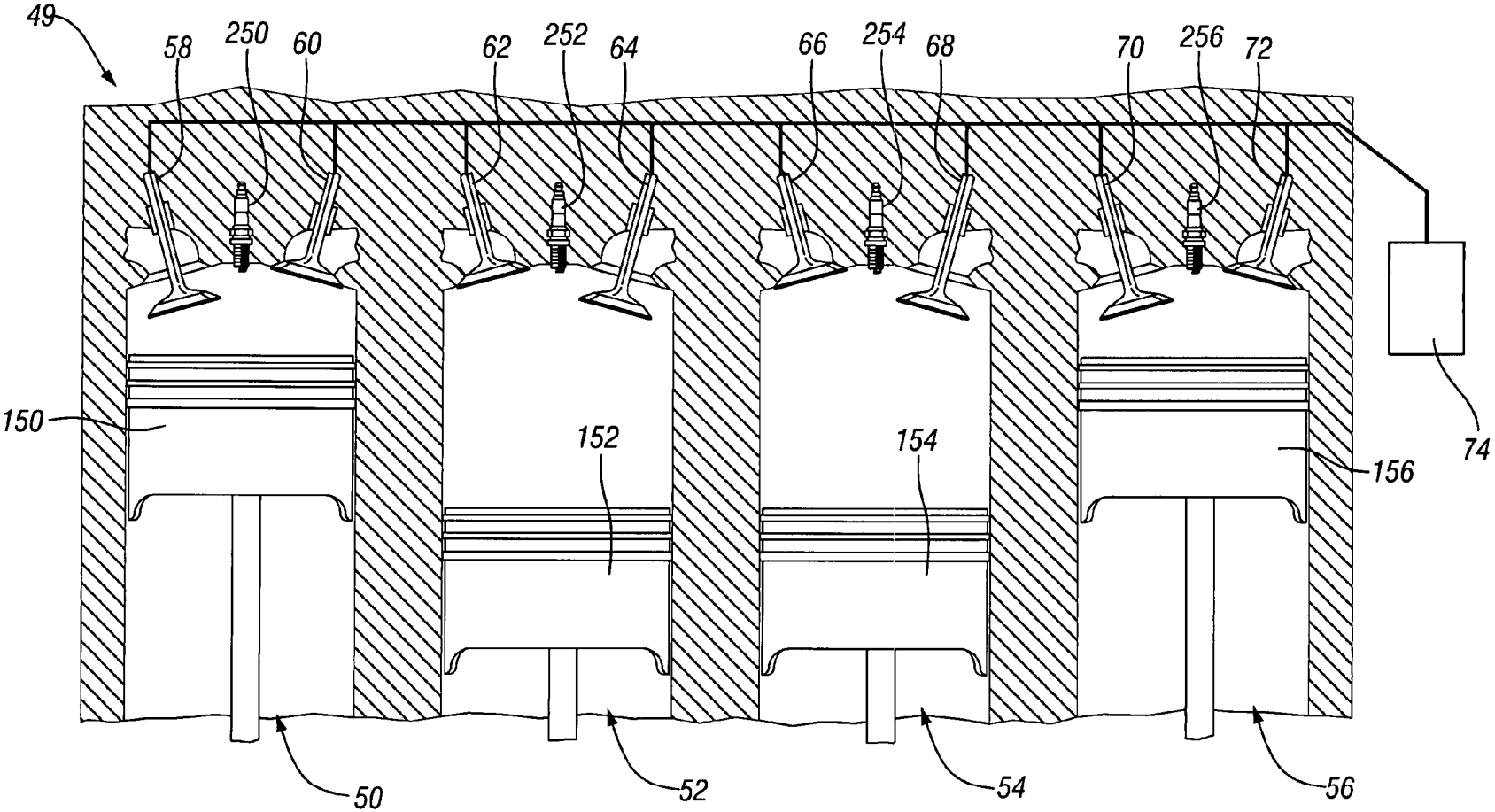
FIG. 3 schematically illustrates in cross section a four cylinder engine in accordance with one embodiment of the invention.

In accordance with an embodiment of the invention, an improved method for starting a four cycle multi-cylinder internal combustion engine opens the inlet valve of cylinders that are to undergo an ineffective (fuel-less) power stroke, and opens an exhaust valve of cylinders that are to undergo an ineffective (fuel-less) compression stroke. By so opening an intake or exhaust valve, the starter motor does not have to perform unnecessary work in moving pistons that are not performing a beneficial function. FIG. 3 schematically illustrates in cross section an multi-cylinder internal combustion engine 49 configured to implement the inventive starting method in accordance with an embodiment of the invention. In accordance with the illustrated embodiment, engine 49 is a two valve per cylinder (one inlet and one exhaust), four cylinder, four-stroke cycle internal combustion engine. Without loss of generality and without limitation, the method in accordance with the invention will be described herein as applied to such a two valve per cylinder, four cylinder engine in order to simplify explanation, although the invention is applicable to engines having more than two valves per cylinder and to engines have more or less than four cylinders.

Engine 49 includes cylinders 50, 52, 54, and 56, with pistons 150, 152, 154, and 156, respectively. Each of the pistons is coupled to a crankshaft (not illustrated) which, in turn, is coupled, at start up, to a starter motor (also not illustrated). The coupling of pistons, crankshaft and starter motor is of a conventional nature known to those of skill in the art. The firing order for such an engine is typically 50-54-56-52 (using the figure numerals). Cylinder 50 also includes an inlet valve 58, an exhaust valve 60 and a spark plug 250, cylinder 52 also includes an inlet valve 62, an exhaust valve 64, and a spark plug 252, cylinder 54 also includes an inlet valve 66, an exhaust valve 68, and a spark plug 254, and cylinder 56 also includes an inlet valve 70, an exhaust valve 72, and a spark plug 256. Inlet valves 58, 62, 66, and 70 and exhaust valves 60, 64, 68, and 72 are electronically controlled by an engine management system 74. The valves may be, for example, electro-hydraulically actuated or electromagnetically actuated, or the like, and are able to operate and actuate independently of engine timing. By "independent of engine timing" is meant that the timing of valve opening and closing is not dependent on crankshaft angle, or on a mechanical camshaft that is coupled to the crankshaft. Management system 74 may be, for example, a microprocessor, a portion of the engine computer, or the like.

FIG. 4 illustrates in chart form the different strokes each cylinder is prepared to perform once the engine is started, including the position of the inlet and exhaust valves for each cylinder in accordance with one embodiment of the invention. Columns 76, 78, 80, and 82 correspond to cylinders 50, 52, 54, and 56, respectively, and rows 84, 86, and 88 illustrate the first three cycles of the engine, respectively. Again in this figure, the letters "I," "C," "P," and "E" refer to the intake, compression, power, and exhaust strokes, respectively. An "x" indicates a valve is closed, and an "o" indicates a valve is open. In accordance with the illustrated embodiments, piston 150 in cylinder 50 is stopped in the TDC position, about to perform a power stroke, piston 152 in cylinder 52 is stopped in the BDC position, about to perform an exhaust stroke, piston 154 in cylinder 54 is stopped in the BDC position, about to perform a compression stroke, and piston 156 in cylinder 56 is stopped in the TDC position, about to perform an intake stroke. The position of the pistons in FIG. 4 is illustrative only, and it is not intended that the method described herein can only be performed if an engine was previously stopped with those specific pistons in the specific positions just described. The method described herein is equally applicable to engines regardless of the position of the pistons when the engine was last stopped.

With continued reference to FIGS. 3 and 4, when engine 49 is started, the starter motor begins turning the crankshaft. Initially piston 150 in cylinder 50 is in position to perform a power stroke when a spark is provided by spark plug 250, but no power is generated by cylinder 50 during this first cycle because there is either no fuel/air mixture or an inappropriate fuel/air mixture in the cylinder. This fuel/air condition results from the engine having "coasted" for a few cycles without fuel being supplied to the cylinders as the engine was previously brought to a stop. In accordance with an embodiment of the invention, rather than having the starter device pull the piston in cylinder 50 downward against a reduced pressure load that would otherwise be created in cylinder 50, engine management system 74 causes inlet valve 58 to open so that air can be drawn into the cylinder. Engine management system 74 can also control the fuel system of the engine so that no fuel is injected into the cylinder when the injection of fuel would otherwise be wasted. Thus when the starter motor turns the crankshaft and causes piston 150 to be pulled downward, air, without fuel present, is drawn into the cylinder through the open inlet valve. Allowing air to enter cylinder 50 reduces the work load on the starter motor by avoiding the creation of a reduced pressure load condition in the cylinder. Allowing air to enter the cylinder (especially without fuel) also may prove beneficial to controlling exhaust emissions as will be explained below. At the same time that cylinder 50 is undergoing a power stroke, cylinder 52 is undergoing an exhaust stroke. As piston 152 moves upward in cylinder 52, engine management system 74 causes exhaust valve 64 to open and a normal exhaust stroke is performed. Air in the cylinder is pushed out through the open exhaust valve. Also at the same time that cylinder 50 is undergoing a power stroke, cylinder 54 is undergoing a compression stroke. As piston 154 moves upward in cylinder 54, engine management system 74 causes exhaust valve 68 to open. The upward traveling piston in cylinder 54, which would normally be performing a wasted compression stroke, because there is no fuel/air mixture in the cylinder to compress, thus simply pushes air out the open exhaust valve. Because exhaust valve 68 is open, no compression takes place in cylinder 54 and the work load on the starter motor is reduced by reducing the pumping load in the cylinder. Also at the same time, cylinder 56 performs a normal intake stroke. Engine management system 74 causes inlet valve 70 to open, and downward traveling piston 156 in cylinder 56 causes a fuel/air mixture to be injected into the cylinder through the open inlet valve. In the first cycle of the starter method in accordance with an embodiment of the invention, the starter motor turns the crankshaft without performing any unnecessary work on pistons undergoing wasted compression or power strokes. "Wasted" strokes are herein defined as stokes that perform no useful function as the cylinder is not properly fueled to aid in turning the crankshaft.

Still with reference to FIGS. 3 and 4, during the second cycle in accordance with an embodiment of the invention, cylinder 50 performs a normal exhaust stroke. Engine management system 74 causes exhaust valve 60 to open and inlet valve 58 to close. Upward traveling piston 150 in cylinder 50 pushes air out through the open exhaust valve. Because no fuel was injected into the cylinder during the previous cycle, no fuel that would cause an increase in exhaust emissions is exhausted. At the same time, cylinder 52 undergoes a normal intake stroke and cylinder 56 undergoes a normal compression stroke. The engine management system causes inlet valve 62 in cylinder 52 to open so that downward traveling piston 152 in cylinder 52 draws a fuel/air mixture into the cylinder. In cylinder 56, the engine management system causes both intake and exhaust valves to be closed so that upward traveling piston 156 compresses the fuel/air mixture that was injected into the cylinder during the previous cycle. Cylinder 56 is ready for a power stroke, but because there is not a proper fuel/air mixture in the cylinder, this is a wasted stroke. Accordingly, in accordance with an embodiment of the invention, the engine management system causes inlet valve 66 in cylinder 54 to open. The engine management system also controls the engine fuel system so that no fuel is injected into the cylinder. Downward traveling piston 154 in cylinder 54, which would normally be performing a wasted power stroke, thus simply draws in air (with no fuel present) through the open inlet valve, reducing the extra work the starter device would normally have to perform by eliminating to the reduced pressure load that would otherwise develop in the cylinder. Again, during this second cycle, the starter motor is not required to perform unnecessary work that would result from a wasted power stroke. In the third and subsequent cycles, internal combustion engine 49 performs in a normal manner because each of the cylinders has begun to fuel properly so there are no wasted strokes.

In accordance with a further embodiment of the invention, as the starter motor begins to turn the crankshaft, engine management system 74 causes an inlet valve to open each time a piston moves downward, regardless of whether the cylinder is ready to perform what would be a power stroke or and intake stroke, and causes an exhaust valve to open each time a piston moves upward, regardless of whether the cylinder is ready to perform what would be a compression stroke or an exhaust stroke. The engine management system also controls the engine fueling so that only ambient air and not fuel is injected into the cylinders during the downward movement of the pistons. Correspondingly, during the upward movement of the pistons, only air is exhausted, not combustion products and not uncombusted fuel. Because one of the intake or exhaust valves is open during each stroke, no compressing must be done in any of the cylinders and none of the pistons must move against a reduced pressure load. The starter motor thus is able to easily turn the crankshaft with a reduced work load. The engine management system continues to open one of the intake or exhaust valves in each cylinder and continues to inhibit fueling until the starter motor is able to turn the crankshaft at a predetermined rotational speed such as 30–90 rpm and preferably about 60 rpm. When the predetermined rotational speed is reached, the engine management system begins to control the intake and exhaust valves in accordance with the method illustrated in FIG. 4 and begins to fuel the cylinders on intake strokes. The engine management system causes the starter motor to be decoupled from the crankshaft when the various cylinders of the engine begin to fire and the engine is able to reliably turn on its own. By delaying fueling and normal operation until the predetermined rotational speed is achieved, the starter motor is able to easily turn the engine and the engine is able to start in a lower exhaust emission mode because exhaust emissions are reduced when the engine starts at a higher rpm. Further, exhaust emissions are also reduced when the fuel/air mixture exhausted from a cylinder and entering the catalytic converter is oxygen rich. By injecting only air into a cylinder on an intake or power stroke and then exhausting that air without fuel on a compression or exhaust stroke, the fuel/air mixture reaching the catalytic converter is lean and produces low emissions.

Thus it is apparent that there has been provided, in accordance with the invention, a method for starting a four-stroke cycle multi-cylinder internal combustion engine that fully meets the needs set forth above. This method reduces unnecessary work that the starter motor must perform during the starting of the engine. This method also helps reduce emissions generated during the startup of the engine by sending an oxygen rich mixture of air to the catalytic converter. The catalytic converter is better able to catalyze the hydrocarbons in the presence of excess oxygen.

Although various embodiments of the invention have been set forth with reference to particular embodiments thereof, it is not intended that the invention be limited to such illustrative embodiments. Those of skill in the art will recognize that many variations and modifications of such embodiments are possible without departing from the spirit of the invention. Accordingly, it is intended to be included within the invention all such variations and modifications as fall within the scope of the appended claims.

What is claimed is:

1. A method for starting an internal combustion engine comprising a plurality of cylinders, each cylinder having at least one inlet valve and one exhaust valve, the method comprising the steps of:

providing spark to a first cylinder undergoing a power stroke;

opening an inlet valve of the first cylinder undergoing the power stroke; and opening an exhaust valve of a second cylinder undergoing a compression stroke.

2. The method of claim 1 wherein the step of opening the inlet valve comprises the step of opening the inlet valve independently of engine timing.

3. The method of claim 1 further comprising the step of inhibiting fueling of the first cylinder when the inlet valve is opened.

4. The method of claim 1 wherein the steps of opening the inlet valve and opening the exhaust valve are independent of engine timing.

5. The method of claim 4 wherein the steps of opening the inlet valve and opening the exhaust valve comprise the steps of opening the inlet valve and opening the exhaust valve electro-hydraulically or electromechanically.

6. The method of claim 4 wherein the steps of opening the inlet valve and opening the exhaust valve comprise the steps of opening the inlet valve and opening the exhaust valve in response to an engine management system.

7. The method of claim 6 further comprising the step of inhibiting fueling of any cylinder undergoing a power stroke in response to the engine management system.

8. A method for starting an internal combustion engine having a plurality of cylinders, each of the cylinders having an inlet valve and an exhaust valve, the method comprising the steps of:

providing spark to a first cylinder undergoing a power stroke;

opening an inlet valve of the first and a second cylinder undergoing the power stroke and an intake stroke, respectively; and opening an exhaust valve of a third and a fourth cylinder undergoing a compression and an exhaust stroke, respectively.

9. The method of claim 8 further comprising the step of inhibiting the injection of fuel during the step of opening the inlet valve of the first and the second cylinder.

10. The method of claim 8 wherein the steps of opening the inlet valve of the first and the second cylinder and opening the exhaust valve of the third and the fourth cylinder are continued until the internal combustion engine reaches a predetermined rotational speed.

11. The method of claim 10 further comprising the step of inhibiting the injection of fuel during the step of opening the inlet valve of the first and the second cylinder.

12. The method of claim 11 wherein the step of inhibiting is terminated when the internal combustion engine reaches the predetermined rotational speed.

13. The method of claim 12 further comprising the step of terminating the step of opening of the inlet valve of the first cylinder undergoing a power stroke after fuel has been injected into the cylinder on an intake stroke.

14. The method of claim 13 further comprising the step of terminating the step of opening the exhaust valve of the fourth cylinder undergoing the exhaust stroke after fuel has been injected into the cylinder on an intake stroke.

15. An engine system comprising:

an internal combustion engine having a plurality of cylinders including a first and a second cylinder;

a spark plug associated with the first cylinder and that generates a spark to the first cylinder during a power stroke;

an inlet valve associated with the first cylinder;

an exhaust valve associated with the second cylinder; and an engine management system that opens the inlet valve of the first cylinder performing a power stroke and opens the exhaust valve of the second cylinder undergoing a compression stroke.

16. The engine system of claim 15 wherein the engine management system further inhibits fuel delivery to the engine during opening of the inlet valve.

* * * * *